US006805900B2

(12) United States Patent
Lewis

(10) Patent No.: US 6,805,900 B2
(45) Date of Patent: Oct. 19, 2004

(54) METHOD OF COATING A SUBSTANCE ON A SURFACE OF AN ARTICLE USING A SINGLE MENISCUS

(75) Inventor: Paul E. Lewis, San Jose, CA (US)

(73) Assignees: Paul Lewis, San Jose, CA (US); Alan Loudermilk, Chicago, IL (US)

( * ) Notice: Subject to any disclaimer, the term of this patent is extended or adjusted under 35 U.S.C. 154(b) by 0 days.

(21) Appl. No.: 10/378,191

(22) Filed: Mar. 3, 2003

(65) Prior Publication Data

US 2003/0138565 A1 Jul. 24, 2003

Related U.S. Application Data

(63) Continuation of application No. 09/766,114, filed on Jan. 19, 2001, now Pat. No. 6,528,117.

(51) Int. Cl.[7] ..... B05D 1/26

(52) U.S. Cl. ..... 427/96; 427/58; 427/162; 427/256; 427/430.1; 427/434.3

(58) Field of Search ..... 427/434.3, 256, 427/430.1, 162, 58, 96; 118/402, 423, 429

(56) References Cited

U.S. PATENT DOCUMENTS 5,270,079 A 12/1993 Bok ..... 427/429
5,581,285 A 12/1996 Watanabe et al. ..... 347/45
5,840,862 A 11/1998 Bensimon et al. ..... 536/22.1
5,965,209 A 10/1999 Komatsu et al. ..... 427/430.1
6,528,117 B2 * 3/2003 Lewis ..... 427/256
2002/0015792 A1 2/2002 Nagayama et al. ..... 427/299

OTHER PUBLICATIONS

Gao, C. et al., "Dip–Coating of Ultra–Thin Liquid Lubricant and Its Control for Thin–Film Magnetic Hard Disks," IEEE Transactions on Magnetics, vol. 31, No. 6, Nov. 1995.

Gao, C, et al., "Tribological Implications of Solvents in Dip–Coating Lubrication of Thin Film Magnetic Disks," HMT Technology paper, Fremont, California, no date.

* cited by examiner

*Primary Examiner*—Katherine A. Bareford
(74) *Attorney, Agent, or Firm*—Loudermilk & Associates

(57) ABSTRACT

A system for applying a thin coat of a material on one side only of a substrate is disclosed together with a process for applying the thin coat. Coatings of less than one thousand angstroms are attainable on a single surface of the substrate by controlling the speed at which a meniscus of a mix containing a predetermined concentration of the to coating material travels across the single surface being coated. Various pressure, temperature and humidity controls are implemented in the process and by the apparatus as needed to obtain the desired coating characteristics.

19 Claims, 5 Drawing Sheets

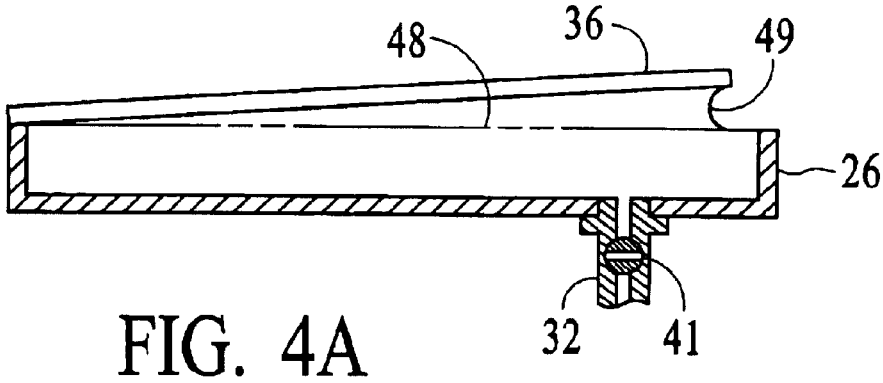
FIG. 4A
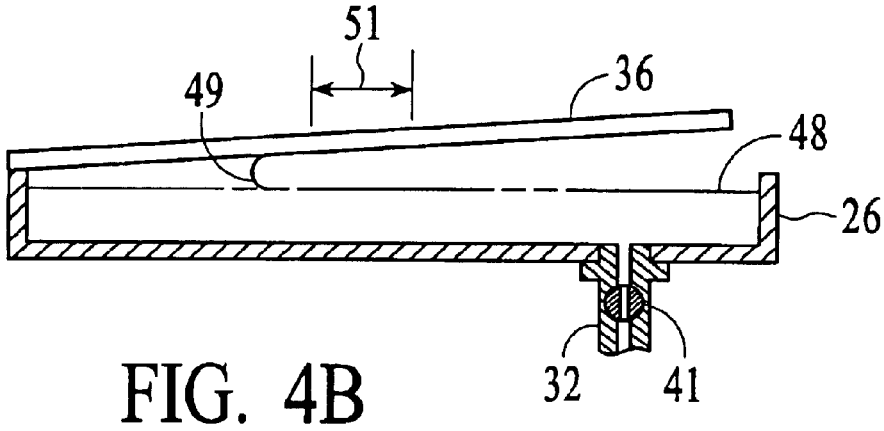
FIG. 4B
FIG. 5
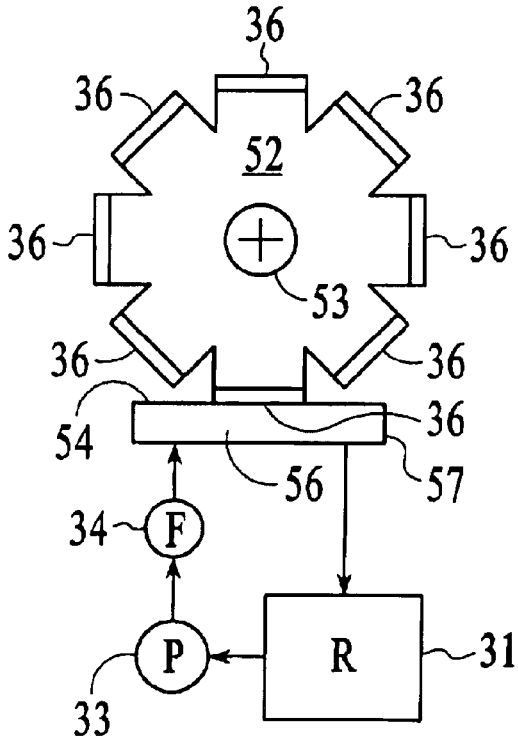

METHOD OF COATING A SUBSTANCE ON A SURFACE OF AN ARTICLE USING A SINGLE MENISCUS

This is a continuation of U.S. patent application Ser. No. 09/766,114, filed Jan. 19, 2001, now U.S. Pat. No. 6,528,117.

FIELD OF THE INVENTION

The present invention relates to systems and methods for applying a thin coat of a substance such as a lubricant, protective, decorative, optical (e.g., filter) or other coating to a substrate, and more particularly to systems and methods for applying such coats to a single side only of a substrate, object or material utilizing a solvent bath containing a concentration of the coating material.

BACKGROUND OF THE INVENTION

Proper application of a thin layer of a substance such as a lubricant or protective film onto a substrate is generally one of the most critical considerations in processes involving the manufacture of items such as magnetic hard discs, semiconductor devices, circuit boards, flat panels such as liquid crystal displays, optical components such as mirrors, lenses, gratings and optical filters, etc. The coating layer must often have a precise and uniform thickness or the functional characteristics of the substrate are adversely affected. Moreover, the coating may have a thickness requirement that is so thin as to be difficult to obtain using generally known processes.

Often times available processes envision coating of both sides of a substrate, coating on only one side being impractical in view of the process. One process used for applying coating to one side of a substrate is called spin coating. In this process a substrate is spun about a rotation axis and a mixture of solvent and the coating material is poured onto the spinning substrata. The thickness of the coating is controlled by controlling the angular velocity of the spinning substrate and the viscosity of the mixture of solvent and coating material. Coatings applied with the spin process are often difficult to control in thickness and generally result in a greater thickness near the outer edges of the spinning substrate.

A process for providing coating thicknesses under one thousand Angstroms together with an apparatus for performing such processes to one side only of a substrate is needed throughout those industries that require ultra thin and precise coating applications.

SUMMARY OF THE INVENTION

In one aspect of the invention, an apparatus is provided for applying a thin coat of a substrate to a substrate, wherein a predetermined concentration of the substance is to mixed with a solvent to formulate a solvent bath. Further, the thin coat is applied to one substantially planar side of the substrate. The apparatus includes means for containing the solvent bath so that a bath surface on the solvent bath is substantially free of disturbance. Means is also provided for positioning the one substantially planar side in contact with the bath surface. In addition, means is provided for tilting the one substantially planar side to assume a predetermined angle with respect to the bath surface while remaining in contact therewith. Means is provided for separating the one substantially planar side from the bath surface so that a meniscus therebetween travels across the one substantially planar side at a predetermined speed.

In another aspect of the invention, an apparatus is provided for applying a thin coat of a substance to one planar side of a substrate, wherein the substance is mixed in a predetermined concentration with a solvent in a solvent bath having a substantially undisturbed bath surface thereon. The apparatus includes a bath container and means for positioning the one planar side of the substrate in contact with the substantially undisturbed bath surface. The means for positioning operates to orient the one planar side at a predetermined angle relative to the substantially undisturbed bath surface. Means is also provided for separating the one planar side from the substantially undisturbed bath surface, whereby a meniscus extends across and between the one planar side only and the substantially undisturbed bath surface. Further, means is provided that operates in conjunction with the means for separating for controlling a speed of traversal of the meniscus across the one planar side, wherein the speed of traversal corresponds substantially to an evaporation rate of the solvent in the solvent bath.

In yet another aspect of the invention, an apparatus is provided for applying coatings of less than one thousand Angstroms thick on one side of a substrate having an area for coating defined by continuous substrate edges. The coating substance is carried in a solvent, thereby providing a predetermined concentration of a coating substance in a solvent mix. The apparatus includes a solvent mix container for holding a quantity of solvent mix, so that the solvent mix has a substantially undisturbed free surface. Further, means is provided for positioning the one side in contact with the substantially undisturbed free surface at an angle thereto, and forming a meniscus adjacent one of the continuous substrate edges. Means is present for separating the one side and the substantially undisturbed free surface to provide a meniscus speed of traversal across the one side that corresponds to the evaporation rate of the solvent. In this fashion the one side is substantially free of solvent immediately following passage of the meniscus.

In still another aspect of the invention, a method is disclosed for applying a thin coat of a substance onto one side of a substrate. The method includes the steps of mixing the substance in a solvent to provide a predetermined concentration of the substance in a solvent mix. The method further includes the step of placing an amount of the solvent mix in a container so that the solvent mix has an accessible undisturbed free surface. Additionally, the method includes the step of positioning the one side in contact with and at a predetermined angle to the accessible undisturbed free surface. A meniscus is formed in the solvent mix extending between the undisturbed free surface and the one side. The process proceeds by separating the one side and the solvent mix at a separation rate so that the meniscus traverses the one side at a rate corresponding to a solvent evaporation rate.

Accordingly, it is an object of the present invention to provide systems and methods for coating one side of a substrate or object in which a meniscus is formed between the substrate or object and a surface of a fluid containing a coating material.

It is another object of the present invention to provide such systems and methods in which the one side of the substrate or object is positioned at a predetermined angle with respect to the surface of the fluid containing the coating material, and the one side and the surface of the fluid move relative to each other such that the meniscus travels across the surface.

It is yet another object of the present invention to provide such systems and methods in which the relative movement between the one side and the surface is substantially not uniform, and the rate of meniscus travel is substantially uniform.

Finally, it is an object of the present invention to provide such systems and methods in which the coating thickness is substantially uniform or of other desired characteristic(s), such as having a thickness below about 1000 Angstroms, and below about 900, 800, 500, 200, 100 and even about 10–20 Angstrom (e.g., lubricant films of 10–20 Angstroms, etc.).

BRIEF DESCRIPTION OF THE DRAWING

The above objects and other advantages of the present invention will become more apparent by describing in detail the preferred embodiments of the present invention with reference to the attached drawings in which;

FIG. 4A is a section through a solvent bath container used in the present invention.

FIG. 4B is another section through the container containing the solvent bath at a later time in the process of the present invention.

FIG. 5 is an elevation partly in block form of an additional embodiment of the present invention.

DETAILED DESCRIPTION OF THE PREFERRED EMBODIMENTS

The present invention will be described in greater detail with reference to certain preferred and certain other embodiments, which may serve to further the understanding of preferred embodiments of the present invention. As described elsewhere herein, various refinements and substitutions of the various elements of the various embodiments are possible based on the principles and teachings herein.

The invention disclosed and claimed herein relates to dip coating one side of a substrate to provide a film of a desired substance such as a lubricant, protective, decorative or other coating on the one side of the substrate, wherein the film desirably may be extremely thin, on the order of less than about one thousand Angstroms. Exemplary coatings include lubricant, protective, decorative, optic (e.g., filters), photosensitive (e.g., photoresist) or other desired coating; generally, any material that may be dissolved in a solvent and desirably applied as a coating may be utilized in accordance with the present invention. Exemplary materials to be deposited include lubricants (e.g, Fomblin lubricants such as Z-DOL), pigments, low K or other dielectrics, photoresist, optic filter materials, etc Exemplary solvents include freon, TF, PF 50/60, HFE, tolulene xylene, water, alcohol, hydrocarbon-based solvents, etc. Exemplary substrates may include items such as magnetic hard discs, semiconductor devices, circuit boards, flat panels such as liquid crystal displays, optical components such as mirrors, lenses, gratings and optical filters, etc., in general, other items, objects or materials may be a substrate for purposes of the invention described and claimed herein.

Figure 1:
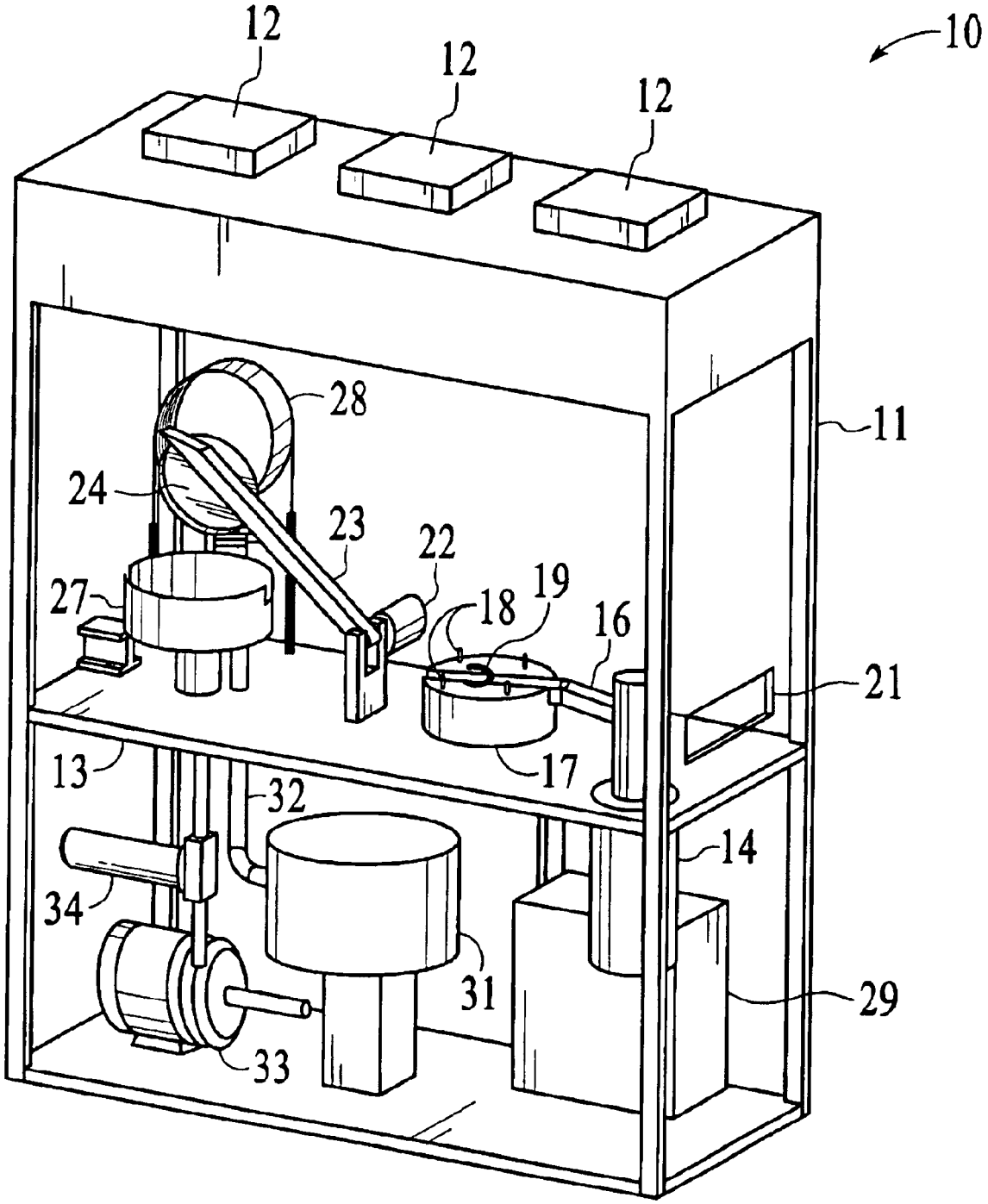
FIG. 1 is a perspective of one embodiment of the system of the present invention.

FIG. 1 shows a single sided coating apparatus 10 having, an enclosure 11 for surrounding the system, but with some sides of the enclosure removed in the illustration so that the system components may be identified. Fan/filter elements 12 preferably are provided on the upper surface of the enclosure 11 to provide filtered air within the enclosure, although in certain alternative embodiments such elements provide an inert, environment within the enclosure, such as by providing a filtered or clean source of an inert gas such as argon or nitrogen. An upper level base 13 is positioned within the enclosure 11 having a robot 14 mounted thereon. The robot has an upwardly extending articulated arm 16 that is controlled in a horizontal plane in the illustrated embodiment. The articulated arm serves to provide substrates to and remove substrates from a load/unload pedestal 17. The load/unload pedestal has a number of substrate lift pins 18 that serve to lift substrates from and deposit substrates on a substrate carrier 19 attached to the free end of the articulated arm 16. As shown in FIG. 1, the articulated arm 16 is situated so that it may pass through an opening 21 in one side of the enclosure 11 to retrieve substrates from a substrate supply and to deposit coated substrates outside the enclosure to a coated substrate supply (not shown). It is envisioned that the environment within the enclosure 11 will not be compromised by the presence of the opening 21, because the atmosphere immediately adjacent to and outside of the opening will be properly controlled to prevent such compromise, and implements such as door that closes the opening also may be provided. It should be understood that: such substrate handling into and out of the enclosure and into and out of the coating mix are exemplary; what is important is that a suitable means be provided for substrates or objects to be coated to controllably enter and exit the enclosure and the coating mix in a manner to have a coating applied based on meniscus travel as described herein.

Figure 2:
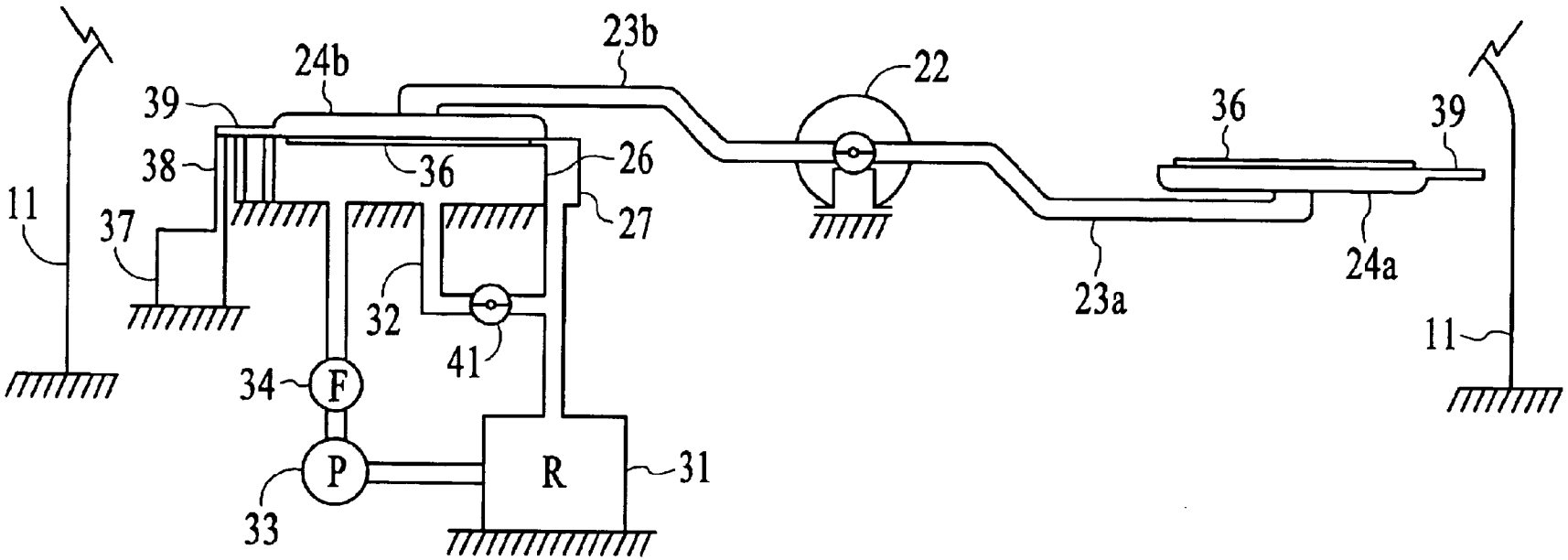
FIG. 2 is an elevation partly in block form of one portion of the system of the present invention.

A wrist motor or actuator 22 for flipping substrates has an actuator arm 23 attached to the shaft thereof at one end and carries a substrate chuck 24 at the other end as shown. The chuck may be pneumatic/vacuum, mechanical, electrostatic or magnetic as appropriate. The wrist motor 22 and arm 23 unction to alternatively position the substrate chuck 24 at the load/unload station 17 and at a surface on a solvent/coating material mix within a solvent bath container 26 (FIG. 2). The solvent bath container 26 is positioned within an overflow capture vessel 27 at what may be called a coating station. When the actuator arm 23 has positioned the substrate chuck 24 within the overflow capture vessel the vessel 27 preferably is covered by a process cover 28, shown in an out of the way position in FIG. 1.

On a lower level in FIG. 1 within the enclosure 11 and beneath the upper level base 13 a refrigeration and temperature control assembly 29 is provided for controlling temperatures at various points in the apparatus 10 as will be hereinafter explained. Further, a reservoir 31 is provided on the lower level of the enclosure 11 for storing the coating material/solvent mix used in the process of the present invention. A fluid conduit 32 extends between the overflow capture vessel 27 and the reservoir 31 as seen in FIG. 1. The fluid conduit 32 also has a branch that extends between the solvent bath container 26 and the reservoir as seen in FIG. 2. A pump 33 is connected to the reservoir 31 for pumping the coating materials/solvent mix from the reservoir 31 via an interconnecting conduit to a filter 34 and subsequently to the solvent bath container 26. The plumbing and storage configuration illustrated herein are exemplary; what is important is that the coating material/solvent mix be supplied to a coating vessel in a controlled manner such as to have a coating applied based on meniscus travel as described herein.

With reference now to FIG. 2 of the drawings, the manner in which the substrates to be coated are moved from the load/unload station 17 to the coating station within the overflow capture vessel 27 is described. The enclosure 11 is shown surrounding the apparatus of FIG. 2 wherein the chuck 24*a* is shown at the load/unload station. A substrate 36 is settled onto the chuck 24*a* at the load/unload station by retraction of the substrate lift pins 18 and the wrist motor 22 is actuated to rotate the arm 23 into the position shown for the chuck at 24*b* in FIG. 2. The arm is shown at 23*a* at the load/unload station and at 23*b* at the coating station in FIG. 2. The overflow capture vessel 27 is shown surrounding the solvent bath mix container 26 so that the solvent bath container 26 may be filled to its upper limit and mix overflow will run into the overflow capture vessel 27. As a result an undisturbed surface is formed across the upper level of a solvent bath within the container 26 at a precise position within the apparatus governed by the position of the upper edge of the container 26. The substrate chuck seen at 24*b* in FIG. 2 is therefore able to precisely position the substrate 36 relative to the undisturbed upper surface of the solvent bath within the container 26 as will be hereinafter explained. A high resolution lifter 37 has an arm 38 extending therefrom. The arm 38 is brought to bear against a tab 39 on the chuck 24 to lift the chuck gradually from the position at 24*b* in FIG. 2 and therefore the substrate 36 from the undisturbed surface of the coating substance/solvent bath within the container 26. This lifting may be for the purpose of imparting a predetermined angle between the surface to be coated on the substrate 36 at the beginning of the coating portion of the process or it may be to lift the one side of the substrate 36 from the free surface of the solvent bath at a controlled rate for a purpose to be hereinafter described.

The process envisions moving the one surface of the substrate 36 away from the undisturbed surface of the solvent bath within the container 26 or moving the surface of the solvent bath away from the ogle surface of the substrate. The process relates to separation of the undisturbed surface of the solvent bath from the one surface of the substrate 36 whether this is affected by one means or the other described herein.

When the free surface of the solvent bath within container 26 is moved away from the surface to be coated on substrate 36, a controlled valve 41 is set to a predetermined open position to allow the solvent bath to drain through the conduit 32 into the reservoir 31 as shown in FIG. 2. The drain rate of the solvent bath from the container 26 may be controlled by the valve 41 to accommodate the shape of the one surface to be coated on substrate 36, for example, to obtain a more uniformly thick thin coating thereon. Alternatively it is envisioned that whether separation of the free surface of the solvent bath is obtained through the use of lifting the one surface to be coated from the free surface of the bath or by lowering the bath surface itself, the separation rate preferably is utilized to obtain the desired coating thickness characteristics. Reference will be made to this part of the process hereinafter.

One of the advantages of the apparatus and process of this exemplary preferred embodiment of the present invention lies in the fact that the coating substance/solvent bath is practically all recovered as it is allowed to drain into the reservoir 31. Subsequently the bath mix is pumped out by the pump 33 and filtered by the filter 34 prior to being placed in a clean condition within the container 26 for processing a subsequent substrate 36.

Figure 3:
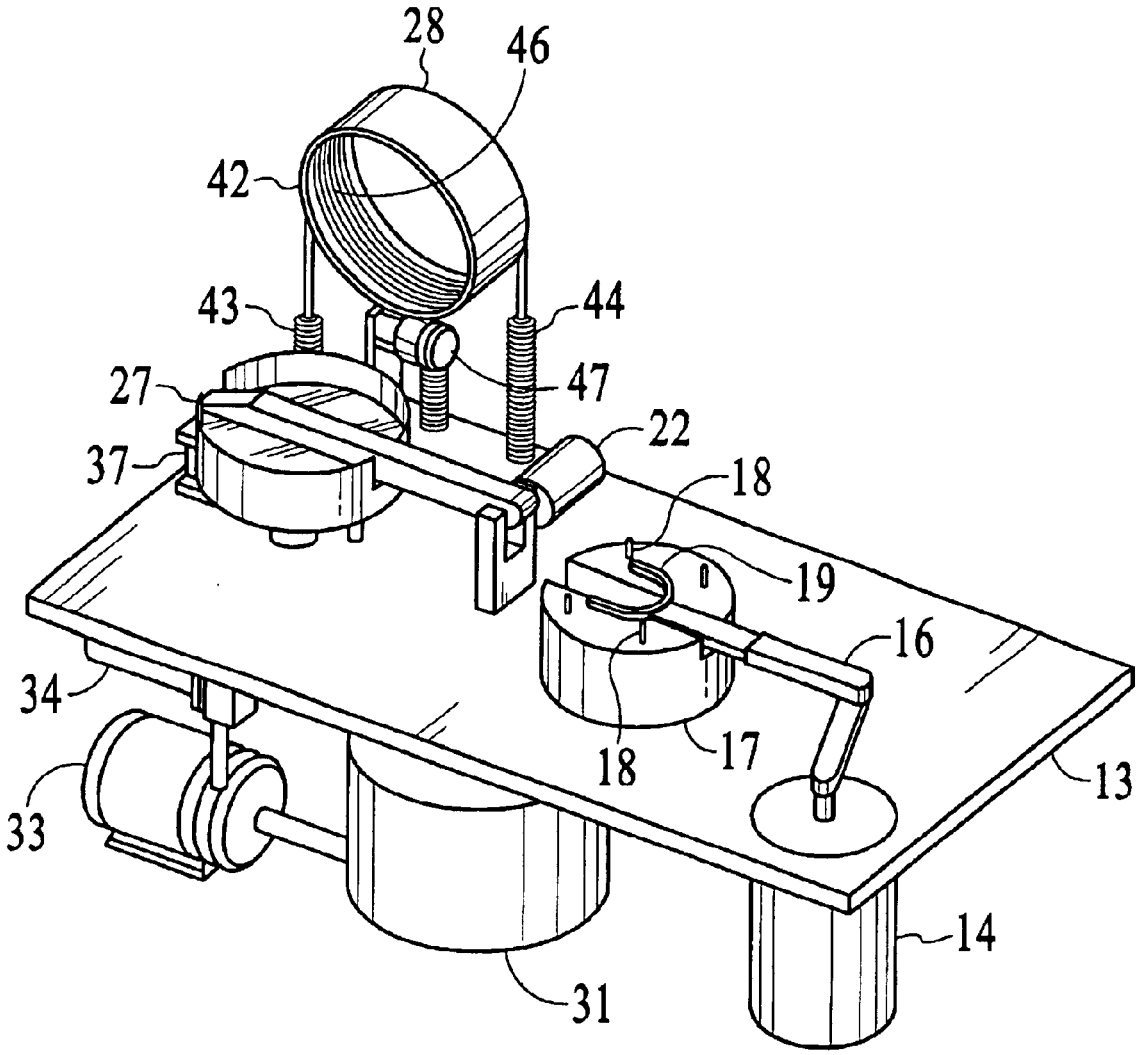
FIG. 3 is a perspective of one portion of the system of the present invention.

In FIG. 3 the process cover 28 is shown in an out of the way position so that a condensation coil 42 is in view. She condensation coil 42 has an inlet conduit 43 and an outlet conduit 44. The conduits 43 and 44 are connected to the refrigeration/temperature control unit 29 of FIG. 1. An exhaust vent 46 is shown in the process cover 28. When a substrate 36 is placed in contact with the free surface of a coating substance/solvent bath within the container 26 (seen surrounded by the overflow capture vessel 27 in FIG. 3), the process cover 28 is lowered by rotating it about the axis of a process cover actuator 47 into a position covering the overflow capture vessel. The concentration of bath vapors and water vapor within the process cover during the coating process taking place at the coating station is controlled by condensing such vapors out of the atmosphere immediately surrounding the one surface being coated. Drying of the surface being coated is thus controlled and contamination on the dried surface is minimized. Further, the temperature within the enclosure 11 preferably is controlled to assist drying of the coating materials/solvent mix on the one surface to be coated. In addition the substrate 36 may be brought to and stabilized at a predetermined temperature to optimize the drawing portion of the process. Such temperatures are dependent on the coating material, the solvent being used in the mix, the concentration of the coating material in the mix, etc.

In FIG. 4A the manner in which the coating material is applied to the one surface to be coated on the substrate 36 is illustrated for one embodiment. As stated hereinbefore, whether the free surface of the coating material/solvent bath moves relative to the surface to be coated or the one surface to be coated moves relative to the free surface is not important, the rate of separation and in particular the of meniscus travel being the primary focus. In FIG. 4A the substrate 36 is placed adjacent to and at a slight angle to the free surface of the solvent bath 48 seen in phantom line in FIG. 4A. The angle between the free surface 48 and the substrate to be coated is exaggerated in the figure for clarity. The one surface to be coated, the lower surface of substrate 36 as illustrated in FIG. 4A, has its entire surface in contact with the solvent bath and is tilted through a predetermined angle as shown so that a meniscus 49 is formed between the undisturbed surface 48 and the surface to be coated at one edge of the substrate.

The control valve 41 in the conduit 32 of FIG. 4A is shown in a closed position. This embodiment with the container 26 and the substrate 36 remaining in the same position relative one to the other, valve 41 is placed ii an open position as seen in FIG. 4B. The free surface 48 of the coating material/solvent bath is seen in a lowered position in FIG. 4B and the meniscus 49 has traversed the surface to be coated on the lower side of substrate 36 toward the left in the figure. In accordance with the present invention, it will be understood that the rate of lowering of the free surface 48 as dictated by the controlled valve 41 will govern the velocity of the leftward movement of the meniscus 49 across the lower surface of the substrate 36. This velocity of leftward movement of the meniscus 49 is controlled by the lowering rate of the free surface 48 in the bath to be, in one instance, at a rate equivalent to the evaporation rate of the solvent in the bath. In such an instance a wetted dimension on the one surface to be coated illustrated at 51 in FIG. 4B is substantially zero. The thickness of the thin coating being applied to the lower surface of the substrate 36 is therefore governed by the concentration of the coating material in the solvent bath. It is possible to control the separation between the free surface 48 and the lower surface of the substrate 36 so that the velocity of leftward movement in FIG. 4B of the meniscus 49 is higher, thereby creating a longer wetted dimension 51 on the surface being coated and thereby obtaining a thicker coat on the surface. While this additional control is available, it is envisioned that the optimum situation is when the velocity of the meniscus 49 is just or about equivalent to the drying rate of the solvent in the bath.

It also will be appreciated that, for particular substrates, objects or materials to be coated, the rate of meniscus travel can be controlled to be substantially uniform or substantially non-uniform, with the degree of uniformity and thickness of the coating dependent upon the rate of meniscus travel. In one alternative embodiments, coating uniformity and thickness also may be controlled by movement of the substrate, object or material from the coating-solvent mix or solution (such as by a robotic arm or the like), or my removing the mix or solution from the containment vessel, and the containment vessel itself may be of non-uniform shape or dimension, with one or more controllable valves or the like so the desired meniscus rate profile may be achieved for the particular desired coating for the particular substrate, object or material.

In FIG. 5 an alternative apparatus for practicing a one-sided coating method in accordance with an alternative embodiment of the present invention is shown. A plurality of substrates 36 are mounted on portions of the circumference of a rotating wheel 52. The wheel 52 rotates about an axis 53 to place successive ones of the substrates 36 in contact with a free surface 54 of a coating material/solvent mix 56 contained within a mix container 57. The embodiment of FIG. 5 may use the fill and drain techniques such as described in conjunction with FIG. 2 utilizing the reservoir 31, pump 33 and filter 34, or the travel of the meniscus 49 across the surface of the one side only to be coated may be obtained by moving the surface to be coated away from the free surface of the solvent bath. In such a case, the number of substrates 36 around the periphery of the wheel and the diameter of the wheel are configured preferably to afford drying of the solvent on the surface being coated substantially at the speed of the travel of the meniscus 49 across the surface as described in conjunction with FIG. 4B. The number of substrates and the dimensions of the wheel will be a function of the concentration of the coating material in the solvent to provide the mix 56 as well as the characteristics of the solvent and the imposed ambient conditions, such as pressure, temperature and humidity. The temperature of the solvent bath containing the concentration of coating material is also a controllable feature in the process of the present invention in the embodiment of FIG. 5 as well as those embodiments previously described. It will be appreciated that the wheel may stop at various positions so that a robot may remove (e.g., vacuum-held, mechanically held or electrostatically or magnetically held substrates) substrates (or other objects being coated) from the wheel frame structure holding the plurality of substrates.

In accordance with other embodiments, other frame or wheel or conveyor structures are utilized. What is important is that the mechanical frame, robotic conveyance, or other system bring the substrates into contact with the coating mix/solution, with the meniscus travel controlled as described herein in order to obtain the desired coating thickness, uniformity or other characteristic.

Figure 6:
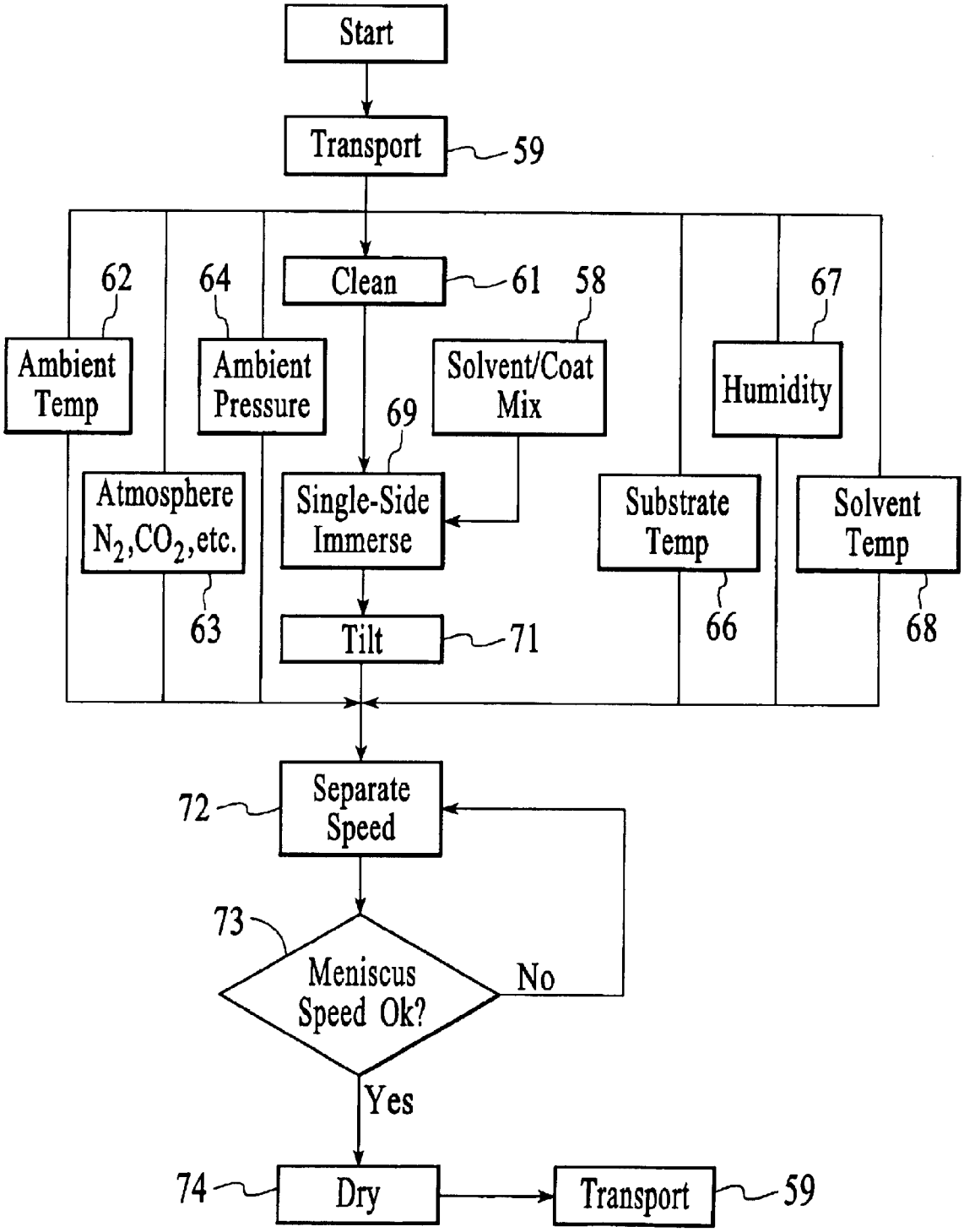
FIG. 6 is a block diagram that illustrates the process of the present invention.

Turning now, to FIG. 6 of the drawings a description of the method of the present invention is undertaken. As previously described, the method relates to applying a thin coat of a substance onto one side only of a substrate. The coating material is mixed in predetermined concentration into a solvent at step 58 in FIG. 6 in order to provide a predetermined thickness or other characteristic of the coat on the single side of the substrate. The thickness of the applied coating will depend to some degree, but not entirely on the concentration of the coating material within the mix. At the start of the process, the substrate is transported at step 59 to a position where the process may be performed and the substrate preferably is cleaned at step 61. As seen in FIG. 6, where appropriate, ambient temperature 62, atmospheric content 63, ambient pressure 64, substrate temperature 66, humidity 67 and solvent temperature 68 are controllable to predetermined levels depending on the type of coating material, the solvent characteristics and the ultimately desired coating characteristics. The substrate is immersed so that one side thereof is wetted in the solvent/coating material mix at step 69, wherein the aforementioned undisturbed surface on the solvent bath is present in the mix. At step 71 the substrate surface to be coated is tilted at a predetermined angle relative to the free surface of the solvent bath so that a meniscus is formed at one edge of the surface to be coated. The substrate surface to be coated and the undisturbed free surface of the solvent bath are separated at step 72 at a predetermined speed of separation to provide a desired velocity/velocity profile of meniscus travel across the surface being coated. The meniscus velocity generally is a function of the separation speed. The separation speed is therefore preferably adjustable to provide the predetermined meniscus speed at inquiry 73. In one embodiment of the process of the present invention the meniscus speed is substantially the same as the solvent evaporation rate, whereby the coating is dry immediately upon the passage of the meniscus on the surface being coated. In other embodiments, the rate of meniscus travel is intentionally controlled to be non-uniform in order to obtain a desired coating. Upon obtaining a dry coating at optional step 74, the coated substrate preferably is returned to the transport step 59, It should be noted that the various ambient controls may be imposed generally within the enclosure 11 of the disclosed apparatus or immediately adjacent the process of coating being performed; i.e., within the process cover 28. The process of the disclosed invention includes providing a separation rate between the surface being coated and the undisturbed solvent bath surface that provides a meniscus traversal at a higher velocity than the evaporation rate of the solvent. In this instance the dimension 51 to which reference is made in FIG. 4B is adjustable to obtain predetermined thickness characteristics in the applied coating. Moreover, the length of the meniscus on the surface being coated may vary as it traverses the surface when dealing with various surface edge shapes. In such cases, the process of the present invention involves controlled variation of the meniscus velocity as it traverses the surface being coated so that uniform coating thickness is obtainable where desired or predetermined thickness variations are obtainable as desired.

Although the invention has been described in conjunction with specific preferred and other embodiments, it is evident that many substitutions, alternatives and variations will be apparent to those skilled in the art in light of the foregoing description. Accordingly, the invention is intended to embrace all of the alternatives and variations that fall within the spirit and scope of the appended claims. For example, it should be understood that, in accordance with the various alternative embodiments described herein, various systems, and uses and methods based on such systems, may be obtained. The various refinements and alternative and additional features also described may be combined to provide additional advantageous combinations and the like in accordance with the present invention. Also as will be understood by those skilled in the art based on the foregoing description, various aspects of the preferred embodiments may be used in various subcombinations to achieve at least certain of the benefits and attributes described herein, and such subcombinations also are within the scope of the present invention. All such refinements, enhancements and further uses of the present invention are within the scope of the present invention.

What is claimed is:

1. A method of applying a coating of a substance onto an article, wherein the article includes a coating-only surface on which the substance is to be coated and one or more other surfaces on which the substance is not to be coated comprising the steps of:

providing a predetermined concentration of the substance in a solvent mix;

placing an amount of the solvent mix in a container so that the solvent mix has a coating contact surface, wherein the coating contact surface comprises a substantially undisturbed free surface and is accessible for contact by the coating-only surface;

positioning the coating-only surface in contact with and at a predetermined angle to the coating contact surface, so that a single meniscus is formed in the solvent mix extending between the coating contact surface and the coating-only surface; and separating the coating-only surface and the solvent mix at a separation rate so that the single meniscus traverses the coating-only surface at a rate related to a solvent evaporation rate.

2. The method of claim 1, further comprising the steps of enclosing the solvent mix and the article, and controlling ambient conditions within the enclosure.

3. The method of claim 2, further comprising the step of controlling ambient temperature.

4. The method of claim 2, further comprising the step of controlling ambient pressure.

5. The method of claim 2, further comprising the step of controlling ambient humidity.

6. The method of claim 2, further comprising the step of controlling the content of the ambient atmosphere.

7. The method of claim 1, further comprising the step of controlling the temperature of the solvent mix.

8. The method of claim 1, further comprising the step of controlling the temperature of the article.

9. The method of claim 1, wherein the meniscus has a wet side adjacent the coating contact surface and a drying side adjacent the coating-only surface, a wetted dimension on the coating-only surface trailing the drying side, and wherein the step of separating comprises the step of imposing a separation rate so that the wetted dimension is substantially constant.

10. The method of claim 1, wherein the meniscus has a wet side adjacent the coating contact surface and a drying side adjacent the coating-only surface, a wetted dimension on the coating-only surface trailing the drying side, and wherein the step of separating comprises the step of imposing a separation rate so that the wetted dimension is substantially zero.

11. The method of claim 1, wherein the meniscus has a wet side adjacent the coating contact surface and a drying side adjacent the coating-only surface, a wetted dimension on the coating-only surface trailing the drying side, and wherein the step of separating comprises the step of imposing a separation rate so that the wetted dimension undergoes a predetermined change, wherein a predetermined variation in the thickness of the coating is obtained.

12. The method of claim 1, wherein the rate of separation produces a wetting dimension about the meniscus that is substantially constant.

13. The method of claim 1, wherein the substance comprises a lubricant.

14. The method of claim 1, wherein the substance comprises a protective or decorative coating.

15. The method of claim 1, wherein the substance comprises an optical coating.

16. The method of claim 1, wherein the coating has a thickness below about 10–20 Angstroms.

17. The method of claim 1, wherein the coating has a thickness below about 100 Angstroms.

18. The method of claim 1, wherein the article comprises a hard disc, a semiconductor device, a circuit board, a display panel or an optical component.

19. The method of claim 1, wherein the article comprises an optical component consisting of a mirror, a lens, a grating or a filter.

* * * * *